United States Patent [19]

Auerbach et al.

[11] 4,311,240

[45] Jan. 19, 1982

[54] FLOTATION APPARATUS

[75] Inventors: Horst Auerbach, Mülheim-Ruhr; Rainer Nebe, Mülheim; Armin Supp, Essen, all of Fed. Rep. of Germany

[73] Assignee: Fried. Krupp Gesellschaft mit veschränkter Haftung, Essen, Fed Rep. of Germany

[21] Appl. No.: 68,585

[22] Filed: Aug. 22, 1979

[30] Foreign Application Priority Data

Sep. 13, 1978 [DE] Fed. Rep. of Germany ..... 2839758

[51] Int. Cl.[3] ..... B03D 1/16

[52] U.S. Cl. ..... 209/169; 210/221.2

[58] Field of Search ..... 209/168–170; 261/87, 93; 210/221 R, 221 M, 221 P, 219

[56] References Cited

U.S. PATENT DOCUMENTS

| | | | |
|---|---|---|---|
| 2,291,031 | 7/1942 | Fahrenwald | 209/169 |
| 2,684,233 | 7/1954 | Payne | 209/169 X |

FOREIGN PATENT DOCUMENTS

| | | | |
|---|---|---|---|
| 2029340 | 4/1971 | Fed. Rep. of Germany | 209/169 |
| 7614453 | 7/1977 | Netherlands | 261/87 |

*Primary Examiner*—William A. Cuchlinski, Jr.

[57] ABSTRACT

A flotation apparatus having a rotor adapted to be rotated about an axis of rotation, which rotor includes an impeller shaft, e.g. a hollow shaft, having a disc at the end immersed in the pump. The apparatus also includes an effective quantity of stabilizer members which are inclined, at least at the height of the rotor, about a perpendicular to the axis of rotation of the rotor.

16 Claims, 4 Drawing Figures

FIG. 1
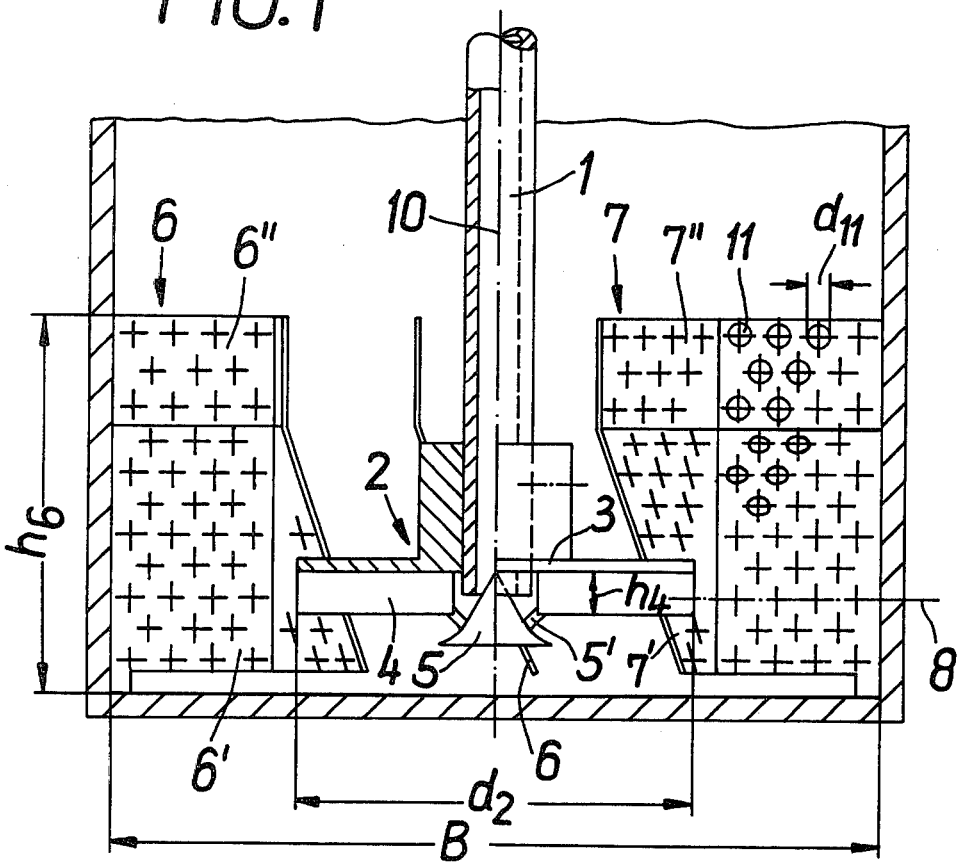
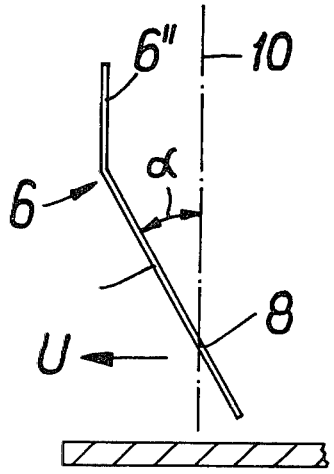
FIG. 3

FLOTATION APPARATUS

The present invention relates to improvements in flotation apparatus.

Flotation apparatus are used in the dressing of ores, salts and coal. In these flotation apparatus there is usually provided at least one rotor or impeller including a disc operatively connected at the lowermost end of an impeller shaft extending into the solution. The impeller shaft is normally hollow. Such flotation apparatus usually also include a plurality of stabilizer shrouds, plates or similar means which are uniformly distributed about the central axis of rotation of the pertaining impeller shaft and which generally extend to the wall of a cell or, in the case of flotation apparatus comprised of several cells, to the next cell unit.

The impeller or rotor of such apparatus serves to suspend the solids in the pertaining fluid, and, usually, the impeller or rotor is also used to introduce the required air into the slurry or pulp for enhancing the upward movement of the solid particles which have become hydrophobic. The stabilizer means positioned about the impeller are to provide for collection of minerals on the air bubbles, simultaneously reducing the turbidity produced by the impeller, and an acquiescent pulp flow.

In a known flotation apparatus the rotor is comprised of a disc and a plurality of downwardly directed fingers evenly distributed about the periphery of, and secured to, the disc. The stator of this assembly includes a plurality of stabilizer plates evenly distributed about the impeller which plates extend from the pertaining cell wall towards the impeller. In this known arrangement, air is introduced into the pulp through a hollow impeller shaft. The pulp, with air dispersed therethrough, is then radially moved into the stator region, whereby the air bubbles and the hydrophobic suspended particles of the pulp which are air-enriched move to the region above the stator. During operation in this known arrangement, the distribution of the rate of air flow per unit area over the width of the cell is highly uneven, and to such extent that the rate of air flow above the rotor is substantially greater than in the region remote from the rotor. This means that the suspended hydrophobic particles near the rims of the cell are not sufficiently enriched with air, and that the flotation equipment will not be utilized at maximum efficiency. Furthermore, the fingers of the rotor produce such an excessive turbulence that the air bubbles deposited in the solid particles may become separated therefrom.

According to U.S. Pat. No. 3,700,103 of Giebel, the rotor or impeller is surrounded by radially extending baffle plates or blades whereby the concave surface of an individual baffle plate is facing in the direction opposite to the direction of rotation of the rotor, so that each of the respective upper and lower ends of the arc has a pertaining direction-component pointing in the direction of rotation of the rotor. Due to the formation of these known deflector means, the pulp is directed upwardly in the upper region of the deflector plate, and the pulp is directed downwardly in the lower region of the deflector plate. The downwardly directed partial streams of the pulp cause an increase of the average residence time of pulp in the region of the rotor and, thus, higher power requirements in relation to the recovery of solid particles to be separated.

It is an object of the present invention to provide a flotation apparatus in which the recovery of the hydrophobic solid particles to be separated from a slurry or pulp is increased and the power consuption is decreased.

This object and other objects and advantages of the present invention will appear more clearly from the following specification in connection with the accompanying drawings, in which:

FIG. 1 is a side elevational view, partly in cross-section of one embodiment in accordance with the present invention;

FIG. 3 is a diagrammatical side elevational view of a stabilizer sheet; and

Figure 2:
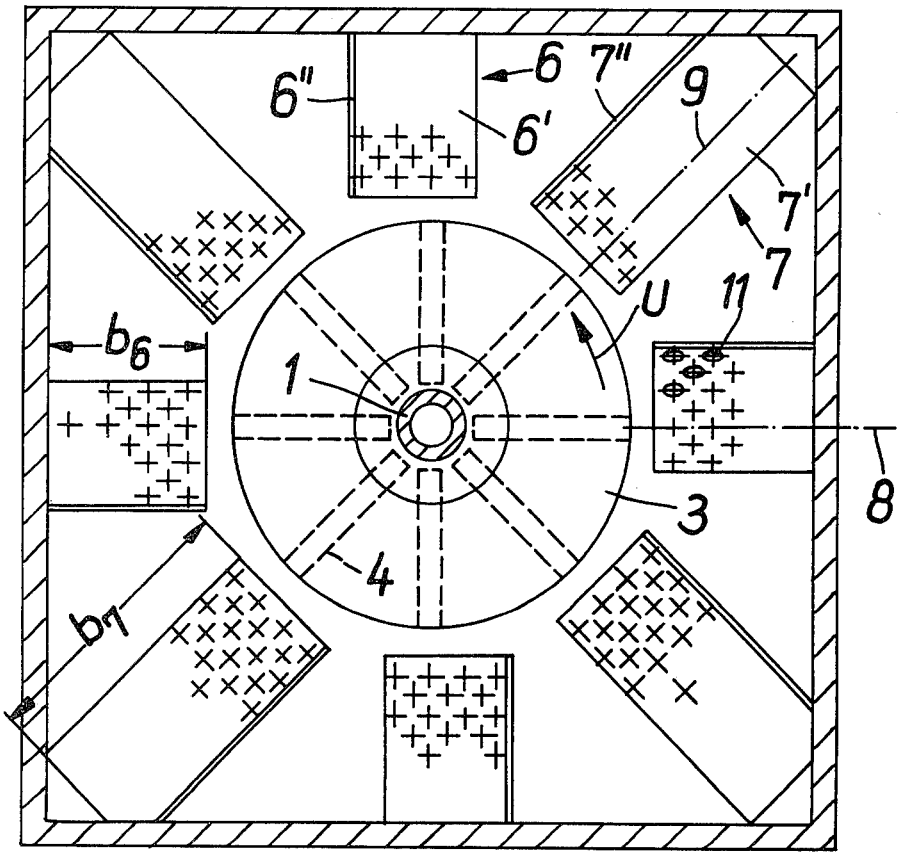
FIG. 2 is a top plan view of the embodiment according to FIG. 1, partly in cross-section.
Figure 4:
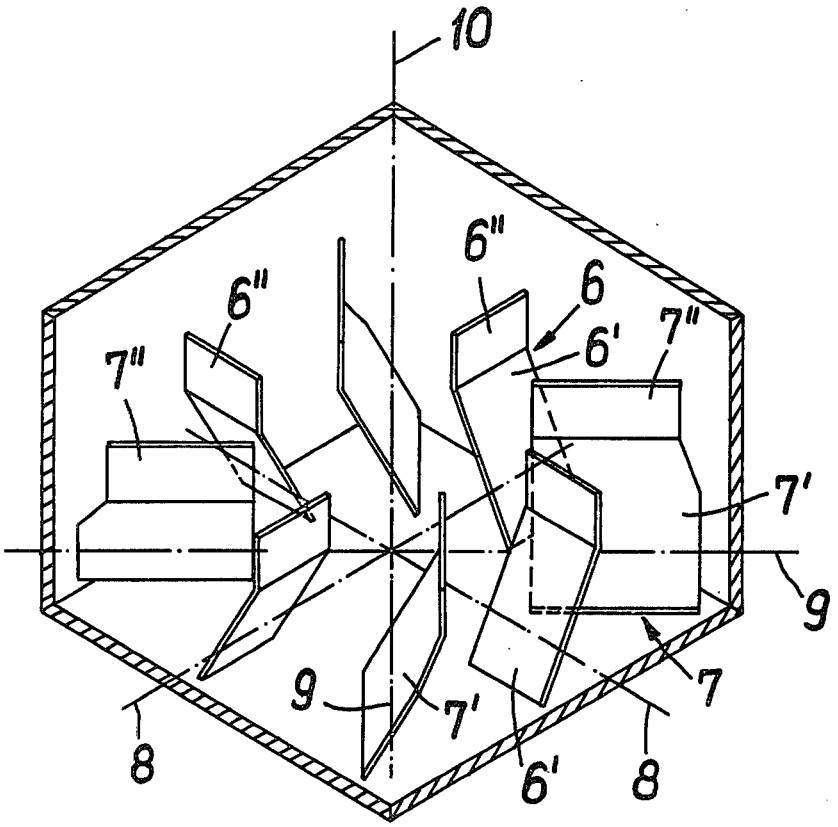
FIG. 4 is a perspective view of the arrangement of stabilizer members of the embodiment according to FIGS. 1 and 2, the wall of the apparatus being partly omitted.

The invention is characterized primarily thereby that the stabilizer sheets, at least at the level of the rotor, are inclined with respect to a pertaining line perpendicular to the axis of rotation of the impeller.

In accordance with one preferred embodiment according to the invention, the angle of inclination is from about 30° to 60° relative to a vertical line or a vertical plane, respectively, and, also, the sheets can be inclined in the direction facing towards the direction of rotation of the impeller.

In accordance with another preferred embodiment, the stabilizer sheets are perforated sheets, and the perforations can have a diameter of from about 8 to 16 mm. Inclined, perforated stabilizer sheets are particularly well suited for comminution and/or dispersion and distribution of air bubbles and conglomerates of solid particles.

In accordance with another preferred embodiment of the invention, the upper portions of the stabilizing sheets extend vertical, so that the particular swirl of the pulp is reduced and the pulp is in a more acquiescent, settled or quiet state.

In accordance with yet another preferred embodiment of the invention, the disc of the rotor is provided with vanes. Preferably, the disc of the rotor has a diameter of from about $\frac{1}{4}$ to $\frac{1}{2}$ of the diameter of the pertaining cell and the height of the vanes can be about 1/30th to 1/10th of the diameter of the disc. Also, the rotor or impeller can be provided at its lowermost end with a cone operatively secured at said end with the diameter of the cone increasing as a function of the distance from the disc. Such configurations are particularly well suited for control of the turbulence of the pertaining pulp.

The present invention also provides that the lines perpendicular to the axis of rotation of the rotor or impeller, about which the stabilizer sheets are inclined, are situated generally at the level of the vanes.

In accordance with yet another preferred embodiment of the invention, the width of the stabilizer sheets amounts to about $\frac{1}{3}$ to $\frac{2}{3}$ of the diameter of the rotor disc.

In accordance with yet another preferred embodiment of the invention, the height of the stabilizer discs corresponds to $\frac{1}{4}$ to $\frac{1}{2}$ of the height of the pertaining cell.

Referring now particularly to the drawings, a hollow shaft 1 is operatively secured to an impeller drive means, not shown. At the lowermost end of hollow shaft 1 there is secured a rotor, generally designated by numeral 2, which is comprised essentially of a disc 3 and vanes/4 secured to the underside of disc 3*d*. At the exit end, or bottom end, of the hollow shaft 1 there is provided an air guide cone 5 which is, for example, connected by cross pieces 5' to the vanes 4.

A plurality of stabilizer members 6, 7 is arranged about the rotor 2. Depending on the position and configuration of a pertaining flotation cell, the individual stabilizer members can be of varying configuration. At the height of the rotor 2, the stabilizer members 6, 7, are inclined about a perpendicular 8 and, respectively, 9 to the axis of rotation 10 of the hollow shaft 1, or rotor 2, to provide lower portions 6', 7' of a pertaining stabilizer member. The upper portion 6'' and, respectively 7'' of the stabilizer members 6, 7 is maintained vertical (FIG. 1). Preferably the stabilizer members 6, 7 are provided by perforated sheets having a plurality of holes 11. The diameter $d_{11}$ of holes 11 is preferably in the range of from 3 to 16 mm.

When the rotor 2 is rotated in the direction indicated by arrow U, air is moved through the hollow shaft into the slurry and is there dispersed. At the same time, the slurry or pulp is pumped in the direction of the stabilizer sheets 6, 7 due to the centrifugal forces caused by the vanes 4. This provides, particularly in the region between the stabilizer sheets 6, 7, small zones of swirl in which the air is distributed in the form of fine bubbles into the pulp so that a greater opportunity is provided for the hydrophobic solid particles to come into contact with the air bubbles. The pulp pumped or moved to between the stabilizer sheets 6, 7 has initially a radial and a circumferential component. Substantially larger air bubbles or conglomerated suspended particles (flocculate) are comminuted or dissolved, respectively, on impact on the stabilizer sheets 6 or 7, particularly at the edges of holes 11. Due to the inclination of the lower portions of stabilizer sheets 6,7, part of the comminuted air bubbles and/or the dissolved suspended particles pass through the holes 11 into the region behind the stabilizer sheets 6,7 while part of the flocculate is removed in upward direction. The stabilizer arrangement in accordance with the present invention, thus, provides for an optimal contact between air and suspended particles and a high degree of suspension. Due to the vertical arrangement of the upper portions 6'', 7'' of the stabilizer sheets 6,7, the pulp is brought to an acquiescent state and maintained in that state.

In tests which are carried out using the equipment just described, impeller arrangements with varying dimensions have been used. In such tests, a high uniformity of the air throughput per unit area was the result. Furthermore, particularly at increased speed (rpm), the energy requirements were substantially less than for a comparable installation using a rotor with fingers and vertical stabilizer sheets. Furthermore, with the equipment according to the embodiment described, the recovery of ore at a given ore content could be appreciably improved.

A stabilizer sheet 6 is indicated in FIG. 3 which sheet is inclined in the direction U. The angle $\alpha$ according to this embodiment is about 30° to the perpendicular. It has been shown that the angle $\alpha$ is preferably of from about 30° to about 60°. The inclination shown, in the direction U of the rotor 2, has been shown to be preferred since the danger exists that the flotation cell or, the flotation apparatus comprised of several cells, respectively, can become silted up when floating material with a large proportion of coarse fractions. On the other hand when finely divided materials are to be floated which tend to flocculate, the inclination of the stabilizer members facing in the direction of the direction of rotation of rotor 2 has been found preferable. In the apparatus according to the foregoing description which were tested those are particularly preferred in which the rotor has a diameter $d_2$ of from about ¼ to about ½ of the cell diameter B and in which the height $h_4$ of vanes is of from about 1/30 to about 1/10 of the diameter $d_2$ of the disc 3.

The present invention is, of course, in no way restricted to the specific disclosure of the specification and drawings, but also encompasses any modifications within the scope of the appended claims.

What we claim is:

1. A floatation apparatus having a rotor adapted to be rotated about an axis of rotation, said rotor including an impeller shaft having a drive-receiving end and adapted to be rotated, said rotor also including a disc operatively connectable to that end of said impeller shaft which is remote from said drive-receiving end thereof, and said apparatus comprising in combination:

an effective quantity of stabilizer means having edges adapted to comminute suspeded solid material particles and air bubbles dispersed therewith unhindered by any shroud for lifting force, each of said stabilizer means, at least at the effective height of said rotor, being inclined counter to direction of rotation for downward deflection with respect to a line perpendicular to the axis of rotation of said rotor which accelerates the particles and air bubbles essentially horizontally in a spiral path of movement, the downward deflection and lifting force being substantially equalized.

2. A flotation apparatus in combination according to claim 1, wherein said apparatus includes a walled container, and wherein corresponding stabilizer members extend from adjoining walls of said container towards said rotor.

3. A flotation apparatus in combination according to claim 2, wherein said apparatus includes a plurality of cells with corresponding stabilizer members extending to the next adjoining cell.

4. A flotation apparatus in combination according to claim 3, wherein each of said inclined stabilizer members is set at an angle of from about 30° to 60° to a plane defined by said axis of rotation of said rotor and said perpendicular to said axis of rotation.

5. A flotation apparatus in combination according to claim 4, wherein each of said stabilizer members is inclined in the direction facing towards the direction of rotation of said rotor.

6. A flotation apparatus in combination according to claim 5, wherein said stabilizer members are perforated.

7. A flotation apparatus in combination according to claim 6, wherein said stabilizer members are perforated with holes of a diameter of from about 8 to 16 mm.

8. A flotation apparatus in combination according to claim 7, wherein said stabilizer members include upper portions substantially integral therewith which extend vertical.

9. A flotation apparatus in combination according to claim 8, and further comprising an effective quantity of vanes operatively secured to that side of said disc which is farthest from said drive-receiving end of said impeller shaft.

10. A flotation apparatus in combination according to claim 9, wherein said rotor has an effective diameter of from about $\frac{1}{4}$ to $\frac{1}{2}$ of the pertaining diameter of said walled container.

11. A flotation apparatus in combination according to claim 10, and further comprising an effective quantity of vanes operatively secured to that side of said disc which is farthest from said drive-receiving end of said impeller shaft, with pertaining vanes having an effective height of from about 1/30 to 1/10 of the pertaining diameter of said disc.

12. A flotation apparatus in combination according to claim 11, and further comprising a conical member operatively connectible at that side of said rotor which is farthest removed from said drive-receiving end of said impeller shaft, said conical member increasing in diameter as a function of the distance from said disc.

13. A flotation apparatus in combination according to claim 12, wherein said perpendiculars to said axis of rotation are located substantially at the effective level of said vanes.

14. A flotation apparatus in combination according to claim 13, wherein the width of a stabilizer member measured in the perpendicular direction to said axis of rotation ranges from about $\frac{1}{3}$ to $\frac{2}{3}$ of the magnitude of the pertaining diameter of said disc.

15. A flotation apparatus in combination according to claim 14, wherein said apparatus includes a walled container and wherein the height of a stabilizer member is in a range from about $\frac{1}{4}$ to about $\frac{1}{2}$ of the height of a wall of said container.

16. A flotation apparatus in combination according to claim 14, wherein said apparatus includes a plurality of cells and wherein the height of a stabilizer member is in a range from about $\frac{1}{4}$ to about $\frac{1}{2}$ of the height of a wall of said cells.

* * * * *

UNITED STATES PATENT AND TRADEMARK OFFICE

CERTIFICATE OF CORRECTION

PATENT NO. : 4311240

DATED : 19 January 1982

INVENTOR(S) : Horst Auerbach, Rainer Nebe and Armin Supp

It is certified that error appears in the above—identified patent and that said Letters Patent is hereby corrected as shown below:

On the title page, the name of the Assignee should read:

(73) Assignee: Fried KRUPP Gesellschaft mit beschränkter Haftung, Essen, Fed. Rep. of Germany Signed and Sealed this

*Thirteenth* Day of *July 1982*

[SEAL]

*Attest:*

GERALD J. MOSSINGHOFF

*Attesting Officer*

*Commissioner of Patents and Trademarks*